US005524930A

United States Patent [19]

Foster et al.

[11] Patent Number: 5,524,930

[45] Date of Patent: Jun. 11, 1996

[54] PERFORATING BLADE AND SIGNATURE

[75] Inventors: Thomas Foster; Rodney Michalk, both of Cedar Park; Scott Summers, Austin, all of Tex.

[73] Assignee: Sure Perf, Inc., Austin, Tex.

[21] Appl. No.: 303,946

[22] Filed: Sep. 9, 1994

[51] Int. Cl.[6] ..... B42D 1/00

[52] U.S. Cl. ..... 281/21.1; 83/660; 83/333; 83/332

[58] Field of Search ..... 281/2, 5, 21.1; 83/660, 333, 332

[56] References Cited

U.S. PATENT DOCUMENTS

| | | |
|---|---|---|
| 2,176,815 | 10/1939 | Hirohashi . |
| 2,956,465 | 10/1960 | Mingo . |
| 3,228,710 | 1/1966 | Chodorowski . |
| 3,843,113 | 10/1974 | Schaffer . |
| 4,669,191 | 6/1987 | Schramm . |
| 4,951,967 | 8/1990 | Michalik . |
| 5,117,721 | 6/1992 | Montrose . |
| 5,146,829 | 9/1992 | Wadzinski . |

FOREIGN PATENT DOCUMENTS

| | | | |
|---|---|---|---|
| 73848 | 8/1948 | Norway | 281/2 |

*Primary Examiner*—David P. Bryant

*Attorney, Agent, or Firm*—J. Nevin Shaffer, Jr.; Shaffer & Culbertson

[57] ABSTRACT

A perforating blade and signature having a unitary blade (12) that is very narrow in width in proportion to its length, with a cutting edge (16) along one longitudinal side. The cutting edge (16) comprises a combination of a number of spaced-apart straight (12) and angled (20) sections arranged so that the angled sections (20) angle inwardly toward a center point (18) on the perforating blade and along a single side of the cutting edge only. In one embodiment the pattern starts with a single long cutting tooth in the center (18) of the blade followed outwardly from the center on both sides with a repeating pattern of three angled teeth followed by a short straight tooth and so forth. The angled teeth (20) are all angled to the same side of the blade so that the resulting fold line (26) has cuts only on one side (29) of the fold line. The angled cuts result in ties (28) that twist easily, and that, therefore, result in fold lines (26) that fold cleanly without gusseting or binding. The angled cuts and teeth can be straight or curved so long as they are angled toward the approximate middle of the blade and are formed on one side of the blade only.

15 Claims, 3 Drawing Sheets

PERFORATING BLADE AND SIGNATURE

BACKGROUND OF THE INVENTION

This invention relates to an improved perforating blade and signature for use in cutting sheet material which is to be folded and joined together.

It has been known in the printing industry of the difficulties in folding paper without creases or wrinkles forming on the inside page of a chopper folded signature. Because of the wide variety of types, sizes, and weights of paper used, the problem faced by the press-person is the selection of a perforating blade that matches the requirement of the paper being used. Some of those problems are gusseting caused by trying to fold multi-web sheets of paper; difficulty in adjusting a variety of blades used with different types of paper, which causes excessive down time; and the inability to bundle the resultant signatures, the folded stacks of papers which are assembled into a book, because the perforations caused by prior blades result in jagged edges which catch on each other. As a result, the modern press person usually has on hand a large collection of a variety of blades carefully selected from trial and error that are selected and utilized depending upon the type of paper, size of book and so forth.

A number of patents have issued in the art for perforating blades. The Michalik patent, U.S. Pat. No. 4,951,967, is representative. This blade comes in three embodiments, each comprised of a pair of blade sections joined together to form a single blade from which teeth have previously been ground in a variety of configurations. The three configurations noted in Michalik are a "U" shape, an "H" shape, and a "Crank" shape. Each of these teeth shapes are formed by teeth with a straight edge from which extends a lateral edge in order to form the above-mentioned shapes. Each of these shapes perforate the paper on both sides of the fold line and are formed with straight edges at 90 degree angles, preferably. This multi-edged, intricate blade formed of two individually ground sections is very expensive to create and operate compared to the blade of the present invention.

In general, prior art blades, including Michalik and others, still fail to solve all of the aforementioned problems and there was still, until the present invention, no single blade that solved all of the aforementioned troubles. In particular, serrated blades known in the art, damage the ties that hold the paper together in between cuts because, in order to operate, they have to cut deeply. As a result, they also damage the opposing perforating rubber which is typically soft so as to enable the serrated blades to penetrate, but which results in the ties being damaged by pushing and spreading the tie within the soft rubber. A harder, opposing, perforating rubber simply does not work with the standard perforating blade. Further, the major problem, simply put, is that when the paper is folded, the ties binding the paper together normally (unless the correct blade for the correct paper is used) will result in wrinkles.

Thus, there is a need in the art for providing a perforating blade and signature that enhances the twisting ability of the ties and that results in ties that do not lose strength during processing and for a single blade that can be used with many different stock weights and so that the resulting perforated signatures are easily bundled without unwanted gussets or wrinkles. It, therefore, is an object of this invention to provide an improved perforating blade and signature for use in the printing industry with a variety of different stock papers and book sizes.

SHORT STATEMENT OF THE INVENTION

Accordingly, the perforating blade and signature of the present invention includes a unitary blade that is very narrow in width in proportion to its length. A cutting edge is created along one of the longitudinal sides of the blade only. The cutting edge is formed by a combination of a number of spaced apart angled, straight or curved sections, and straight sections. The angled, straight or curved sections are arranged so that they angle or curve inwardly from both ends of the blade towards a center point on the perforating blade. Importantly, the angled sections are angled or curved so that the resulting cut is along a single side of the fold line only. That is, the sections curve and/or angle away from the edge in the same direction on both sides of the center point.

Further, a foldable signature of the present invention is foldable along an elongated fold line, the fold line having a number of spaced perforations extending through the sheets comprising the signature, the spaced perforations also comprising a combination of straight cuts and angled, straight or curved cuts. The cuts, again, are angled to the inside of the elongated fold line and all on a single side of the elongated fold line only. Each of the perforations are spaced apart from the adjacent perforation by a tie.

BRIEF DESCRIPTION OF THE DRAWINGS

Other objects, features and advantages of the present invention will become more fully apparent from the following detailed description of the preferred embodiment, the appended claims, and the accompanying drawings in which:

DETAILED DESCRIPTION OF THE PREFERRED EMBODIMENT

Figures 1, 2:
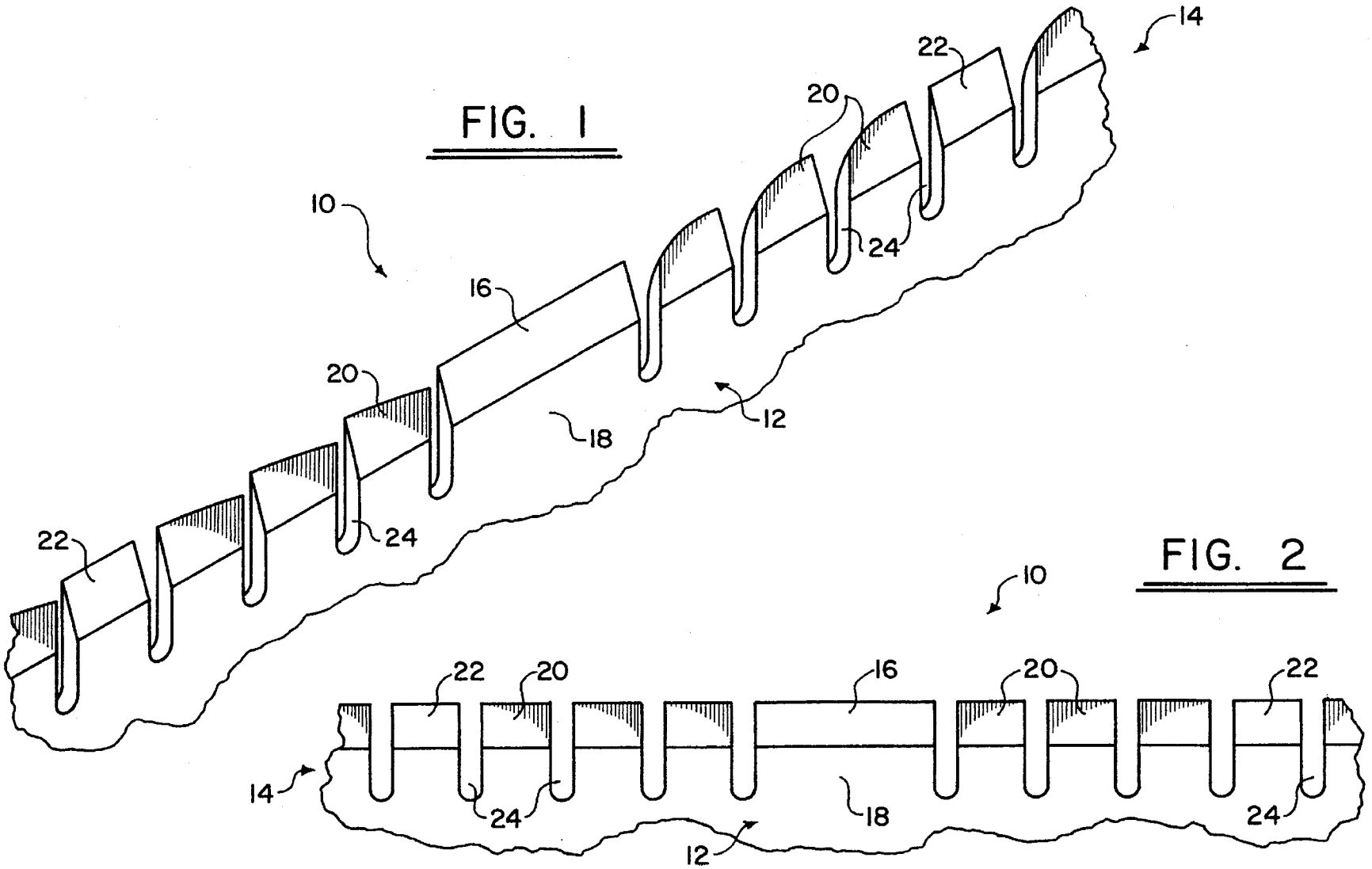
FIG. 1 is a perspective view of a portion of a preferred embodiment of the perforating blade of the present invention and showing the straight and angled perforating sections.
FIG. 2 is a side elevation view of the perforating blade of FIG. 1.

The preferred embodiment of the present invention is illustrated by way of example in FIGS. 1–5. With specific reference to FIGS. 1 & 2, a perforating blade 10 includes unitary blade body 12 that is very narrow in width compared to its length. One longitudinal edge 14 is used for the formation of a single longitudinal straight cutting edge 16 located generally at the approximate center mid-point 18 of unitary blade body 12. Depending on printing needs, the center mid-point 18 can be several inches from the mathematical center of blade body 12. A series of angled, curved in this figure, teeth 20 and straight teeth 22 extend outward from mid-point 18 on both sides of single, long, straight cutting edge 16. The curved teeth 20 and the straight teeth 22 are spaced apart from each other by gaps 24. These gaps 24 result in uncut sections of paper, called ties, that vary in width according to the gap 24. The gap 24 in a preferred embodiment varies from between ⅛ of an inch to 1/32 of an inch throughout the fold line after each curved tooth 20. Importantly, the gap 24 after each straight section is less than the gap 24 after each curved section so that the tie following the straight cut is the narrowest tie on the fold line. Tie width is critical to the twisting action and tinsel strength of the ties. The center portion of the fold being the most critical area has the minimum width tie. The outer portions have the maximum tie width. This also allows for a different twisting action and tinsel strength needed from printing press to printing press.

Figure 3:
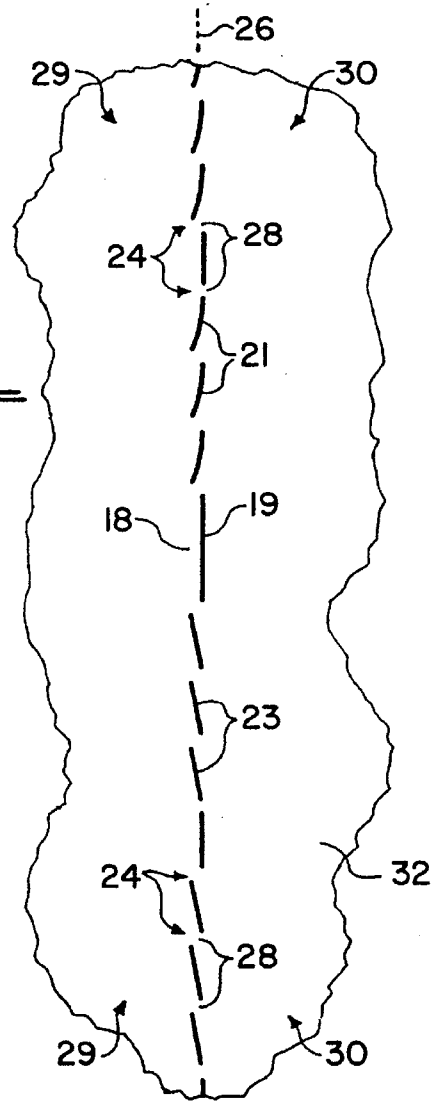
FIG. 3 is a top plan view of a perforated signature fold line made by the perforating blade of the present invention showing straight and angled, curved and straight perforations.

Referring now to FIG. 3, the gaps 24 can be seen along the fold line 26. FIG. 3 also demonstrates two important advantages of the present invention over prior art-perforating blades. To begin with, the ability of the signature to fold has been determined to be dependent upon the ability of the ties 28 to twist. By means of the present invention, the curved teeth 20 result in curved cuts 21 that enable twisting better than prior art straight or straight angled cuts. Angled straight cuts 23 all to the same one side only of center cut 19 are also shown in FIG. 3. These function well also, so long as the cuts are all to the same side of center line 26 on both sides of center cut 19, as required by the invention.

Additionally, FIG. 3 illustrates another significant advantage of the present invention in that the curved teeth 20 are arranged so that the resultant curved cuts 21 curve inwardly toward center point 18 from both sides of center point 18. Thereby, the inventors have found, facilitating a gussetless fold. Important, too, is that the fold line 26 has perforations, whether straight or curved, that extend only on one side 29 of the fold line 26 and not on the opposite side 30 of the fold line 26. As more clearly shown in FIG. 4, too, when the signature is folded along chopper fold 34, the elongated fold line 26 has perforations on the inside 36 of signature 32 only and not on the outside 38 of signature 32. This means that there are no loose edges or flaps of paper which extend exteriorly of the fold and this enables the easy stacking of signatures 32 for binding without the signatures catching on each other, as is common with prior art perforating blades and resulting signatures. Again, the cuts to the inside of the fold benefit the inside portion of the folded signatures in the prevention of gussets and wrinkles. It also keeps the outer portion of the signatures free of any jagged edges that would interfere with delivery on the press, bundling tables and the binding process.

Figure 5:
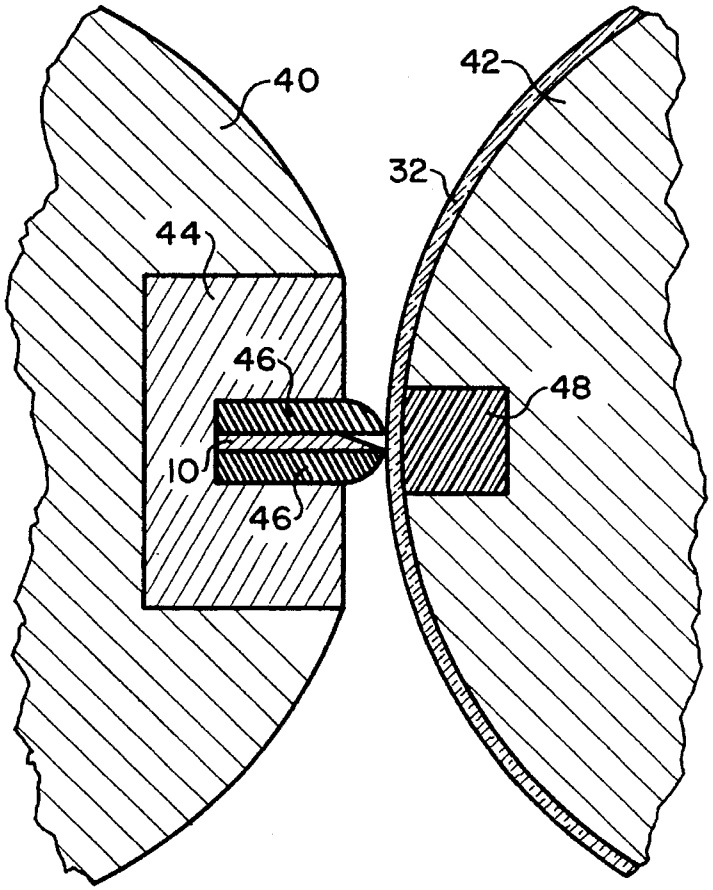
FIG. 5 is a cross-sectional view of a perforating cylinder and showing a blade block and perforating blade.

Referring now to FIG. 5, there may be seen a portion of a folding mechanism of a rotary printing press which includes a perforating cylinder 40 and cooperating counter perforating cylinder 42. The perforating cylinder 40 has a blade block 44 and a pair of cheek rubbers 46 which encompass perforating blade 10. Perforating blade 10 is located at or very near the top of blade cheek rubbers 46 so when the signature 32 is cut by perforating blade 10 the cheek rubbers 46 help push the perforated paper off the blade.

An additional advantage of the perforating blade of the present invention is that the elastic bar 48 can be much harder because the sharp narrow blade 12 of the present invention does not have to extend so far from the cheek rubbers 46 to cut the signature 32 as required by most blades known in the art. Again, as a result, the elastic bar 48 can be much harder. As a further result, the signature 32 is not captured within a groove that forms early in the soft elastic bars of prior art blades. Therefore, the perforations of the present perforating blade are clean and sharp and the ties are not stretched or broken by the action of the blade being removed from a deep groove as normally occurs, again, with soft elastic bars of the prior art.

A further advantage of the thin, narrow blade 12 of the present invention is that, because it is able to be located at or below the cheek rubber level, it reduces blade flick, the action of the blade flicking against the elastic bar as it rotates out of the channel normally formed in the elastic bar. This minimizes wear and tear on the blade and minimizes stress on the ties. The curvature of the curved edge, when used, is designed to prevent damage to the cutting surface by having the same circumference as the counter part cutting surface with a minimum depth requirement. Importantly, the curved and straight edges all to the same side enhance the twisting action of the ties during chopper fold. They also allow for a wider range of chopper and delivery adjustments.

In general, the perforating blade 10 of the present invention, enables signatures to be folded more advantageously than prior art perforating blades because perforating blade 10 results in the creation of ties 28 that twist mechanically and easily. This is the result of the straight and/or curved teeth 20 that are, in the preferred embodiment, angled generally at 22 degrees measured to the outermost point of curved teeth 20. In general, however, the best results are achieved in straight and/or curved teeth that are angled from 10 to 40 degrees. The blade may have all curved cuts with the exception of straight cutting edge 16. Further, a preferred embodiment of the present invention includes a repeating pattern of three angled, straight or curved teeth 20 followed by a straight tooth 22. The purpose of the intermittent straight tooth is to provide a signature that has straight cuts, interspersed with the angled cuts, that help the signature hold the fold line 26 when folded. It should be recognized that curved teeth 20 could be "U" shaped or straight angled so long as the pattern and placement is as described herein.

Figure 4:
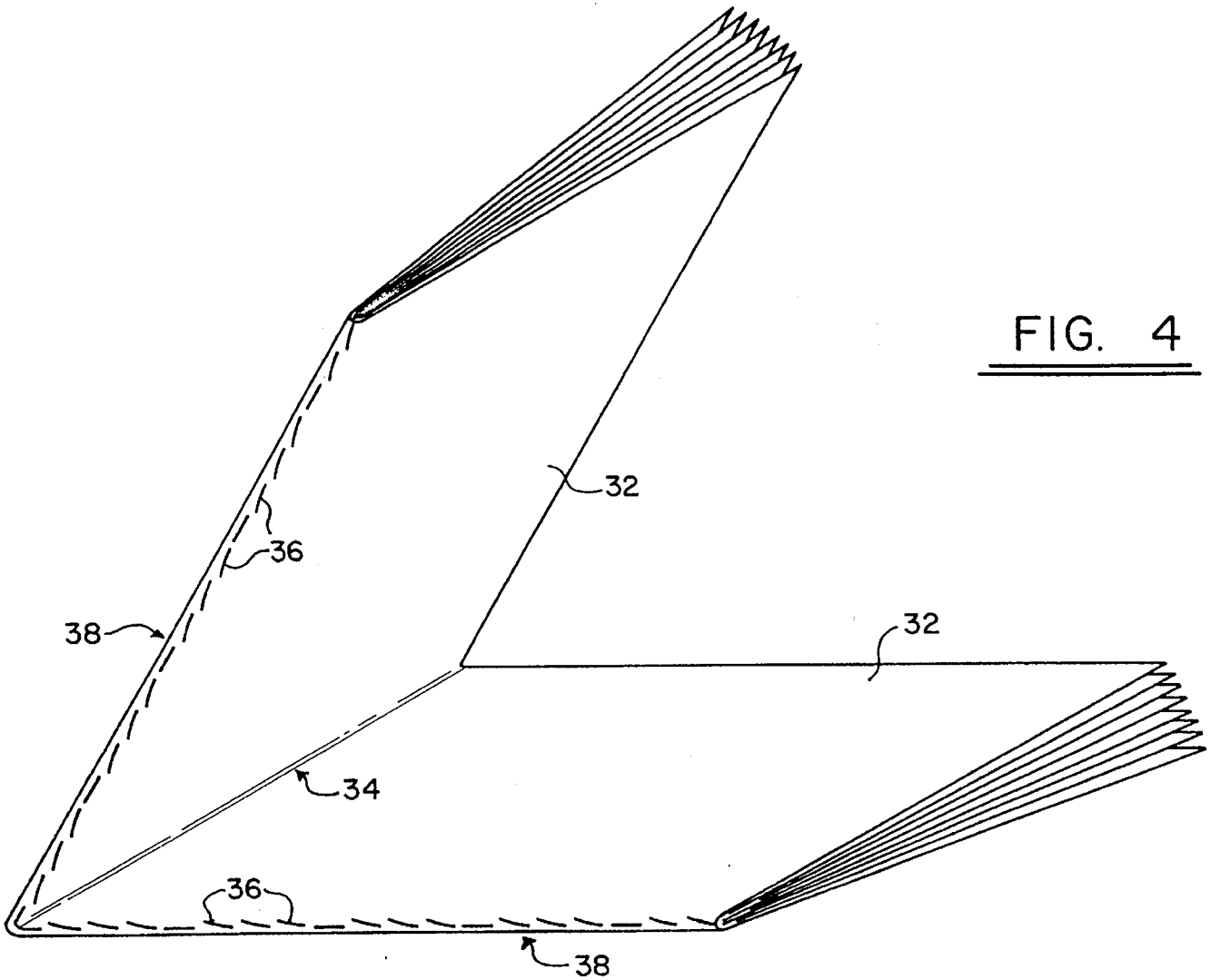
FIG. 4 is a perspective view of a signature being formed after a chopper fold and illustrating the signature fold line formed by the perforating blade of the present invention.

Again, the perforating blade 10 of the present invention results in a signature with a fold line comprised of a succession of angled, straight and/or curved cuts and straight cuts. A series of ties, 28, result with the outside of the angled cut pointing toward the chopper fold line 34 starting from the outer edges of the folded signature, as shown in FIG. 4. This results in opposite angled cut ties 28 facing toward the center from the two sides of the chopper fold 38. That is, all of the angled cut ties start generally at the outer edge and angle toward the inside of the folded signature as shown in FIG. 3. The inventors have found that this direction gives the tie 28 its best twisting action during the chopper fold sequence. One reason is that the angled cut cuts across the grain of the paper and weakens it thereby enabling it to twist more easily.

The present invention provides an improved perforating blade and signature which eliminates the need for press operators to collect an expensive array of blades for use with various weights, sizes and types of paper and finishes. A single blade of the present invention can be utilized with the complete range of papers seen by press-persons, is economical and simple in design, and has the important advantage of providing a blade that is versatile and easy to use.

While the present invention has been disclosed in connection with the preferred embodiment thereof, it should be understood that there may be other embodiments which fall within the spirit and scope of the invention as defined by the following claims.

What is claimed is:

1. A perforating blade comprising:

(a) a unitary blade means very narrow in width in proportion to its length; and (b) a cutting edge along one longitudinal side of the unitary blade;

(c) said cutting edge comprising a combination of a plurality of spaced apart straight and angled sections arranged so that the angled sections face inwardly toward a center-point on said perforating blade and along a single side of a central plane of said cutting edge.

2. The perforating blade of claim 1 wherein the angled sections on both sides of the center point are angled at 22 degrees towards the center point.

3. The perforating blade of claim 1 wherein the angled sections are angled from between 10 degrees to 40 degrees toward the center point.

4. The perforating blade of claim 1 wherein the combination of straight and angled sections starts at the center point with a single long straight edge followed on both sides of the center point by a repeating pattern of three angled edges and one straight edge.

5. The perforating blade of claim 1 wherein gaps formed between the sections are between ⅛ to 1/32 of an inch after each angled section and less than that after each straight section.

6. The perforating blade of claim 1 wherein the cutting edge includes a combination of angled cuts and a single straight cut.

7. The perforating blade of claim 1 wherein the angled sections are curved.

8. The perforating blade of claim 1 wherein the angled sections are straight.

9. A foldable signature having a plurality of sheets, said foldable signature being foldable along an elongated fold-line, the fold-line having a plurality of spaced perforations extending through the plurality of sheets, the spaced perforations comprising a combination of straight cuts and angled cuts, the angled cuts angled away from the elongated fold-line and all on a single side of the elongated fold-line; each of the perforations being spaced from adjacent perforations by a tie.

10. The foldable signature of claim 9 wherein the angled cuts on both sides of a center point on the elongated fold-line are angled 22 degrees toward the center point.

11. The foldable signature of claim 9 wherein the angled cuts are angled from between 10 degrees to 40 degrees toward a center point on the elongated fold-line.

12. The foldable signature of claim 9 wherein the combination of straight and angled cuts starts at a center point on the elongated fold-line with a single long cut followed on both sides of the long cut by a repeating pattern of three angled cuts and one straight cut.

13. The foldable signature of claim 9 wherein each tie is between ⅛ to 1/33 of an inch throughout the fold line after each angled cut and less than that after each straight cut so that each tie following each straight cut is narrower than the ties after each angled cut on the fold line.

14. The foldable signature of claim 9 wherein the angled cuts are curved.

15. The foldable signature of claim 9 wherein the angled cuts are straight.

* * * * *

UNITED STATES PATENT AND TRADEMARK OFFICE

CERTIFICATE OF CORRECTION

PATENT NO. : 5,524,930

DATED : June 11, 1996

INVENTOR(S) : Thomas Foster, et al

It is certified that error appears in the above-identified patent and that said Letters Patent is hereby corrected as shown below:

In Claim 1, Column 4, Line 61 of the Patent, delete the word "means".

In Claim 1, Column 4, Line 65 of the Patent, delete "(c)".

In Claim 13, Column 6, Line 19 of the Patent, change "1/33" to --1/32--.

Signed and Sealed this

Tenth Day of September, 1996

*Attest:*

*Attesting Officer*

BRUCE LEHMAN

*Commissioner of Patents and Trademarks*